US006786349B2

(12) United States Patent
Najd

(10) Patent No.: US 6,786,349 B2
(45) Date of Patent: Sep. 7, 2004

(54) TIP-RESISTANT REFUSE CONTAINER

(76) Inventor: Fadi Najd, 1005 Melrose Ave., Blackwood, NJ (US) 08012

( * ) Notice: Subject to any disclaimer, the term of this patent is extended or adjusted under 35 U.S.C. 154(b) by 0 days.

(21) Appl. No.: 10/298,421

(22) Filed: Nov. 18, 2002

(65) Prior Publication Data

US 2004/0094558 A1 May 20, 2004

(51) Int. Cl.[7] ..... B65D 88/76
(52) U.S. Cl. ..... 220/484; 220/483; 220/495.06
(58) Field of Search ..... 220/603, 483, 220/480, 481, 495.06, 484

(56) References Cited

U.S. PATENT DOCUMENTS 2,791,347 A * 5/1957 Boehm ..... 165/45
4,331,341 A 5/1982 McKeown
4,782,970 A 11/1988 Edwards
4,872,582 A 10/1989 Sipple
5,067,686 A 11/1991 Peterson
5,186,350 A * 2/1993 McBride ..... 220/739
5,653,366 A * 8/1997 Liserre ..... 224/539
5,862,932 A * 1/1999 Walsh et al. ..... 220/8
5,887,834 A 3/1999 Gellos et al.
6,065,632 A * 5/2000 Moore, Jr. ..... 220/483
6,129,213 A 10/2000 Edwards

* cited by examiner

*Primary Examiner*—Joseph Man-Fu Moy
(74) *Attorney, Agent, or Firm*—Paul & Paul

(57) ABSTRACT

A refuse container system that resists tipping due to wind or animal activity is disclosed. The system includes a support plate adapted to be anchored to the ground and a refuse container having a magnet supported by the container's bottom. The plate should be made of a material that is attracted by a magnet. The magnetic attraction between the support plate and the magnet attached to the bottom of the refuse container gives the refuse container added resistance to tipping.

10 Claims, 5 Drawing Sheets

TIP-RESISTANT REFUSE CONTAINER

BACKGROUND OF THE INVENTION

1. Field of Invention

This invention relates generally to a refuse container that has greater resistance to tipping.

2. Brief Description of the Related Art

In many localities it is common practice to leave refuse in a refuse container at the side of the road for pickup by refuse collectors. The refuse collectors empty the refuse containers and then leave the empty refuse container at the side of the road for their owners. Very often the empty refuse container is blown over by the wind, which can cause damage to the refuse container or the refuse container lid. Occasionally, the empty refuse container may roll or be blown into the path of traffic, thus creating a potential hazard to motorists and the risk of severe damage to the refuse container or its lid. In addition, animals attempting to get at the refuse in the refuse container may tip the refuse container and scatter the contents over a wide area. This greatly inconveniences the refuse collectors who would have to spend a great deal of time gathering up the scattered refuse.

The problems enumerated above have caused several tip-resistant refuse container designs to be proposed in the art. U.S. Pat. No. 5,887,834, issued to Todd A. Gellos et al. on Mar. 30, 1999, discloses a stake having hooks and a tether for keeping the refuse container from tipping over. The stake of Gellos et al. remains above ground and would impair the appearance of the surrounding scenery or nearby residence. Furthermore, the projecting stake may pose a hazard to unwary pedestrians who may bump into the stake.

U.S. Pat. No. 4,872,582, issued to Gene L. Sipple on Oct. 10, 1989, discloses a weighted refuse container that uses a liquid filled compartment to weigh down the refuse container in order to make the refuse container more resistant to tipping. The liquid compartment is not convenient to fill and empty. Furthermore, the added weight of the liquid makes the refuse container of Sipple more difficult to handle when the container is full of refuse. The need persists in the art for a refuse container that is resistant to tipping while having a minimal impact on the aesthetics of the surrounding area and on the handling of the container when it is full of refuse.

SUMMARY OF THE INVENTION

The present invention is directed to a refuse container system that resists tipping due to wind or animal activity. The system includes a support plate adapted to be anchored to the ground and a refuse container having a magnet supported by the container's bottom. The plate should be made of a material that is attracted by a magnet. The magnetic attraction between the support plate and the magnet attached to the bottom of the refuse container gives the refuse container added resistance to tipping.

BRIEF DESCRIPTION OF THE DRAWINGS

Like reference numerals indicate like elements throughout the several views.

DETAILED DESCRIPTION OF THE INVENTION

Figure 1:
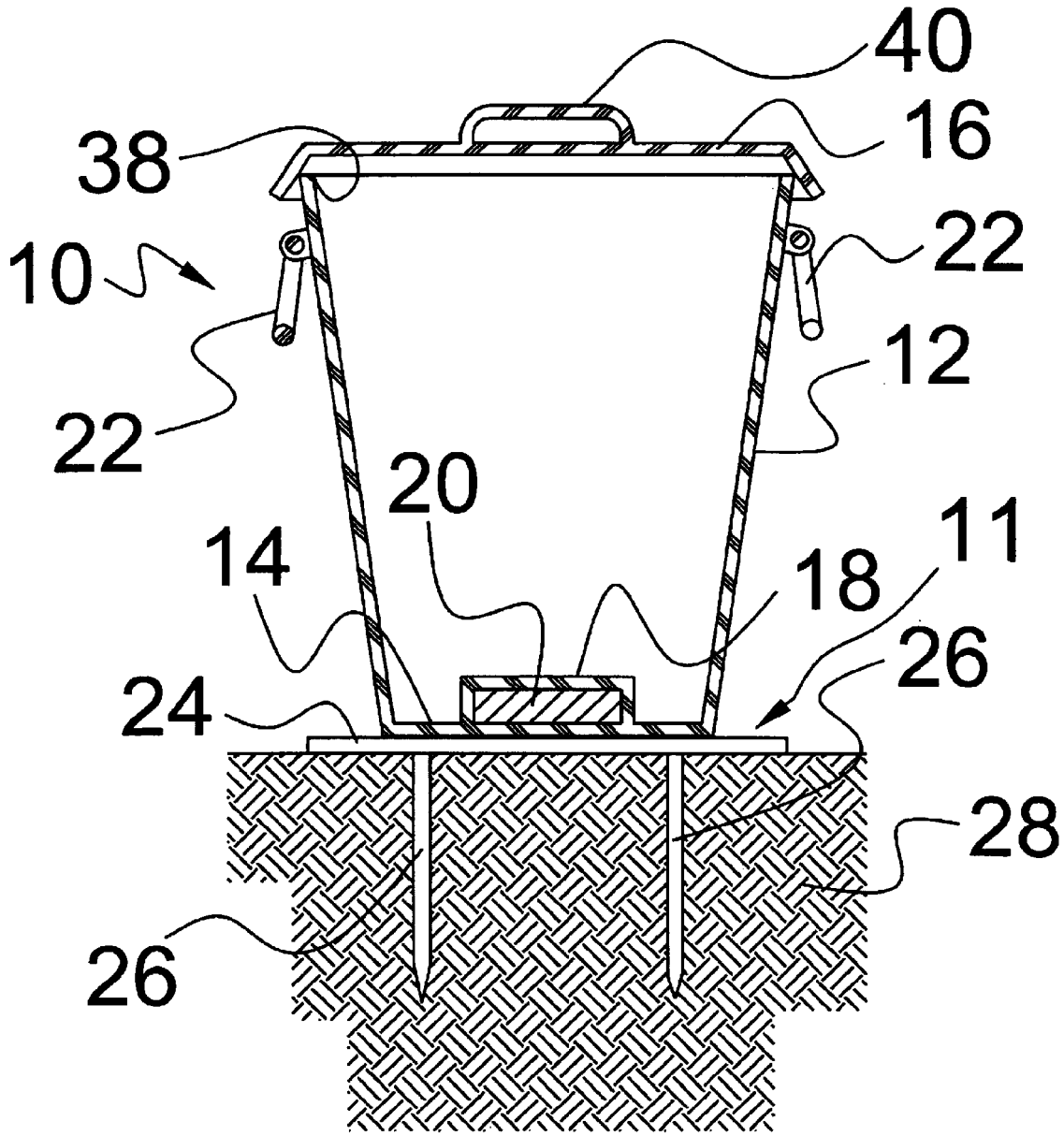
FIG. 1 is a cross sectional view of a first embodiment of a tip-resistant refuse container system according to the present invention wherein the base plate is anchored to the ground by spikes.
Figure 4:
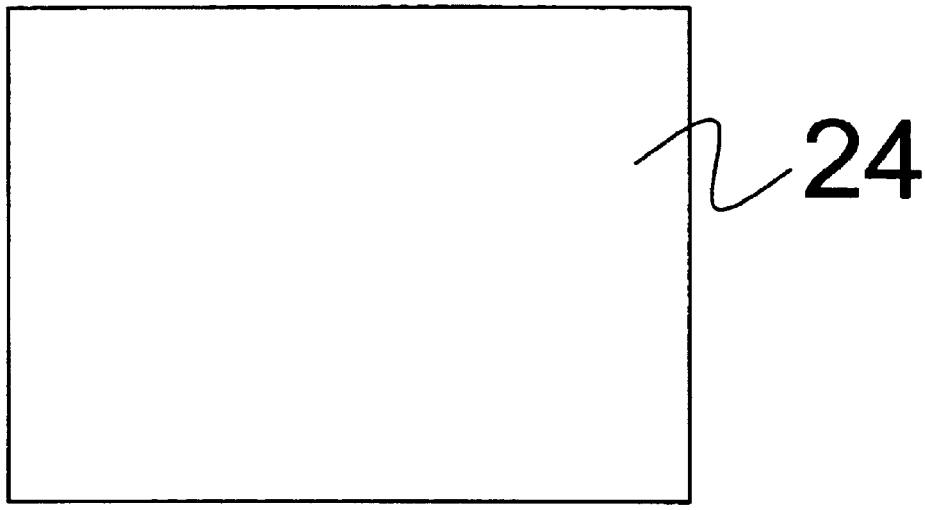
FIG. 4 is a plan view of the base plate of the embodiment of FIG. 1.

Referring to FIGS. 1 and 4, an illustrative example of a tip-resistant refuse container system according to the present invention can be seen. The tip-resistant refuse container system includes a refuse container 10 and a support plate 11. The refuse container 10 has a bottom 14 and an upward extending sidewall 12. The refuse container 10 also has an open top 38 for placing refuse in the container 10. The refuse may be thrown loosely in the container 10 or the refuse may be enclosed in trash bags that are then placed in the container 10. Further, the container 10 may be used with a trashcan liner. The sidewall 12 surrounds the bottom 14 and extends from the bottom 14 to the top opening 38 to define an open-topped container. The refuse container 10 may further include a closure for the top opening 38. In the illustrated examples, the closure is in the form of a lid 16 that has a handle 40. Furthermore, the tip-resistant refuse container 10 can be provided with handles 22 that are attached to the side wall 12 as shown in the illustrated examples.

The refuse container system also includes a magnet 20 supported by the bottom 14 of the refuse container 10. The magnet 20 is held in place relative to the bottom 14 of the refuse container 10 by a housing 18 that is attached to the bottom 14 of the container. The housing 18 can be attached to the bottom 14 of the refuse container 10 in a variety of ways, for example, by welding, by using adhesives, cement, rivets, bolts, or screws, or by molding the bottom 14 and the magnet housing 18 together in one piece. In the illustrated embodiments, the side wall 12, the bottom 14, and the magnet housing 18 are all made of a tough plastic such as polyethylene, polyvinyl chloride, and the like, and are molded together in one piece. The bottom 14 and the magnet housing 18 are molded together in one piece around the magnet 20 to hold the magnet 20 in place at the bottom of the refuse container. Although in the illustrated embodiments the refuse container is made of plastic, it can also be made of metals such as, for example, galvanized or stainless steel.

Alternatively, the magnet 20 may be directly attached to the bottom 14 of the refuse container 10 in a variety of ways, for example, by welding or by using adhesives, cement, rivets, bolts, or screws. Furthermore, depending upon the dimensions of the magnet 20 and the thickness of the bottom 14 of the refuse container, the magnet 20 may be embedded in the bottom 14. It is not strictly necessary for the magnet 20 to be fully encased by the bottom 14 and the housing 18. However, it is preferred to isolate the magnet 20 from the interior of the refuse container 10 to prevent liquids typically present in refuse from corroding the magnet 20, especially if the magnet 20 is made of ferrous material. The magnet 20 or portions thereof may be exposed to the exterior of the bottom 14 and be adapted to be flush with the exterior of the bottom 14. Alternatively, ferromagnetic plates may extend between the magnet 20 and the exterior of the bottom 14.

Such arrangements intensify the magnetic attraction at the top surface of the support plate 11.

In addition, if the magnet 20 is positioned adjacent the side wall 12, the magnet 20 may be supported at least in part by the side wall 12 as long as the magnet is close enough to the bottom 14 of the refuse container such that an adequate magnetic attraction can be developed between the magnet 20 and the support plate 11 or 11*a*. Furthermore, when the magnet 20 is positioned adjacent the sidewall 12, a portion of the magnet housing 18 may be formed by the sidewall 12.

The magnet 20 can be provided in a variety of shapes and configurations such as, for example, block, plate, disk, and annulus shapes. The housing 18 can then be shaped to correspond to the shape of the magnet 20.

The support plate 11 is adapted to be anchored to the ground 28. The support plate 11 includes a substantially flat plate portion and means for anchoring the plate portion to the ground. In the illustrated example of FIGS. 1 and 4, the support plate 11 includes a substantially flat plate portion 24, and the means for anchoring the plate portion to the ground includes at least one spike 26 attached to the bottom side of the plate portion 24. In the illustrated example the support plate 11 is shown with a pair of spikes 26 that are welded to the bottom side of the plate portion 24. It is also possible to braze, sinter, or solder the spikes 26 to the plate portion 24.

Figure 2:
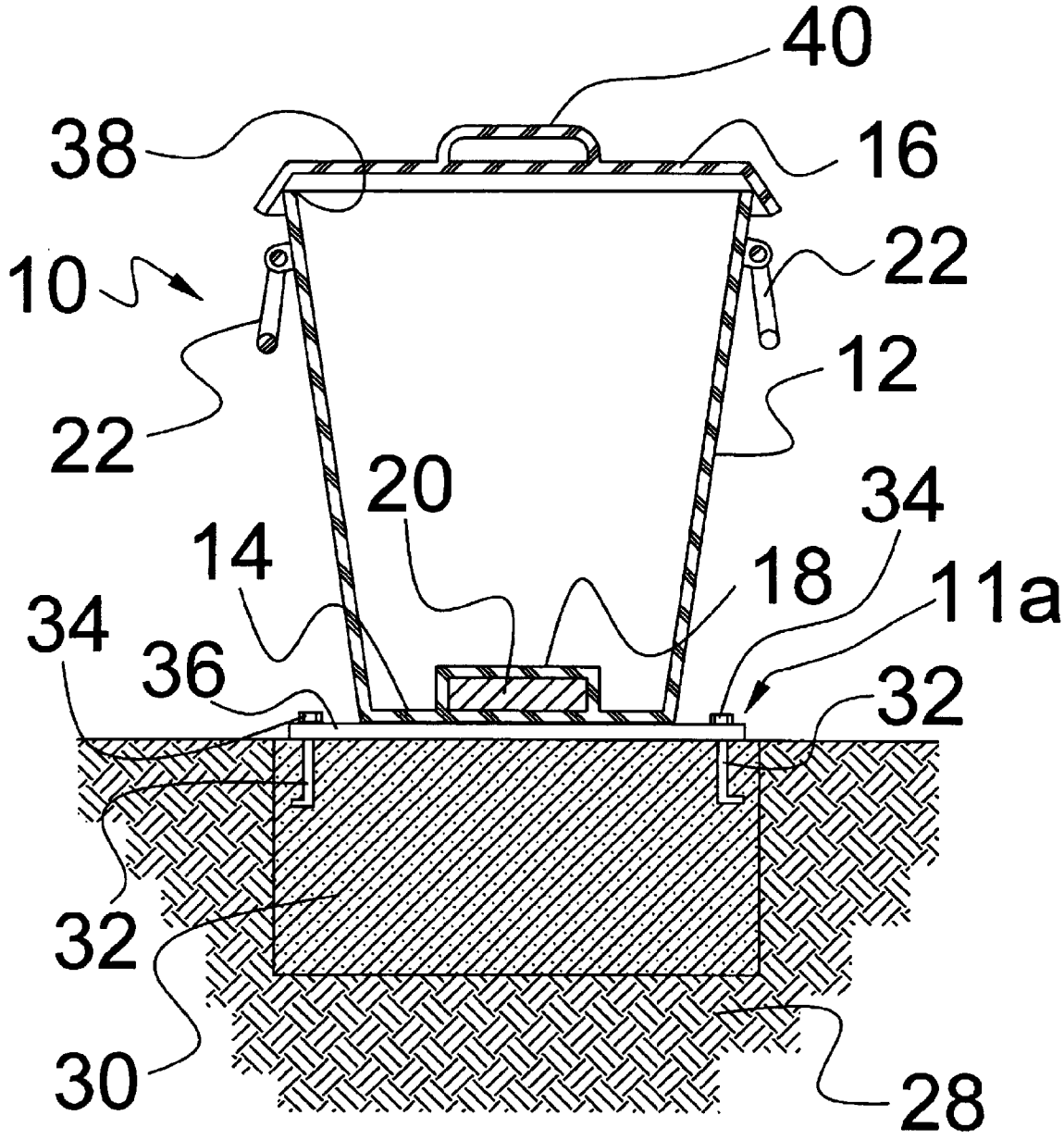
FIG. 2 is a cross sectional view of a second embodiment of a tip-resistant refuse container system according to the present invention wherein the base plate is anchored to a solid surface such as concrete, brick, stone, etc.
Figure 5:
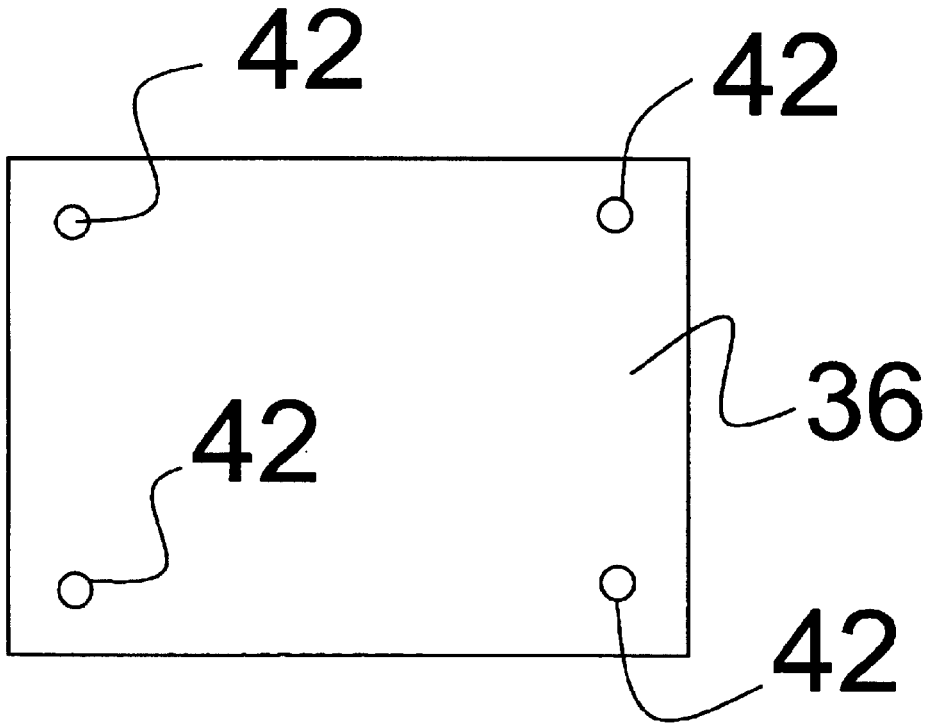
FIG. 5 is a plan view of the base plate of the embodiment of FIG. 2.

Referring to FIGS. 2 and 5, a second embodiment 11*a* of the support plate can be seen. The support plate 11*a* includes a substantially flat plate portion 36 and means for anchoring the plate portion to the ground. In the illustrated example of FIGS. 2 and 5, the plate portion 36 has at least one hole 42, and the means for anchoring the plate portion to the ground includes at least one anchor bolt 32 that is adapted for being anchored to a concrete support structure 30. The means for anchoring the plate portion to the ground also includes nuts 34 that correspond in number to the anchor bolts 32. The concrete support structure 30 is securely anchored to the ground 28 by, for example, having at least some portion that is buried below the surface of the ground 28. The anchor bolt 32 has a threaded portion adapted to extend through a respective hole 42 in the plate portion 36. The nuts 34 are adapted for threadably engaging the threaded portion of the anchor bolts 32. The anchor bolt 32 has a hooked or bent end that is embedded in the concrete 30. Once the plate portion 36 is placed on the concrete 30 with the anchor bolts 32 extending through their respective holes, nuts 34 are tightly engaged to the anchor bolts 32 to thereby anchor or secure the plate portion 36 to the concrete support structure 30.

The concrete support structure 30 may be specially made for supporting the plate portion 36, or the concrete support structure 30 may be part of a curb, foundation, walkway slab, or other structure. Furthermore, the plate portion 36 can be anchored to any solid surface such as concrete, brick, stone, etc. Where the plate portion 36 is to be anchored to a preexisting structure, the structure can be drilled and then masonry anchors can be inserted in the drilled holes. The plate portion 36 can then be secured to the support structure using the masonry anchors and appropriate fasteners adapted to engage the masonry anchors.

Figure 3:
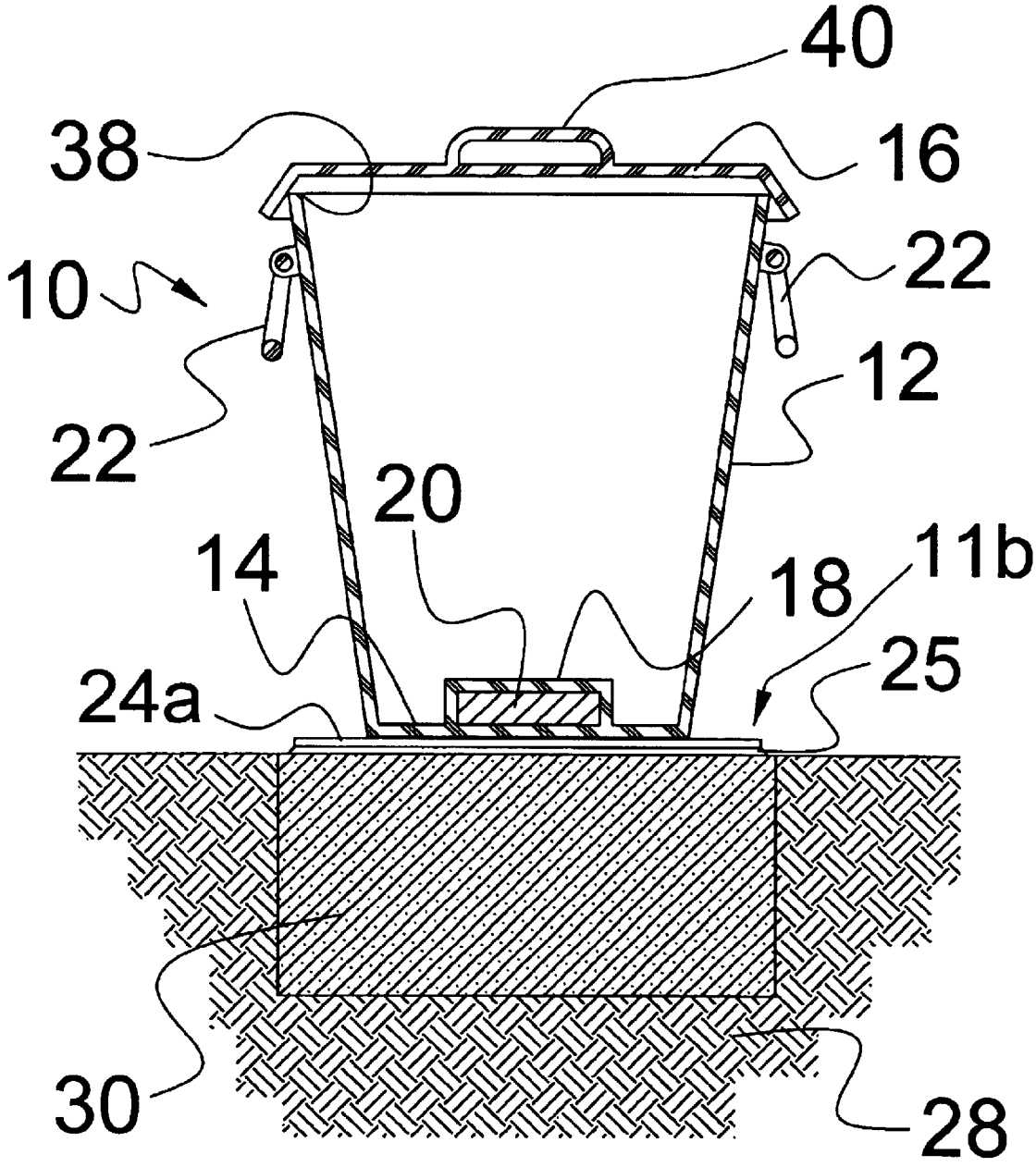
FIG. 3 is a cross sectional view of a third embodiment of a tip-resistant refuse container system according to the present invention wherein the base plate is anchored to the ground surface by epoxy.
Figure 6:
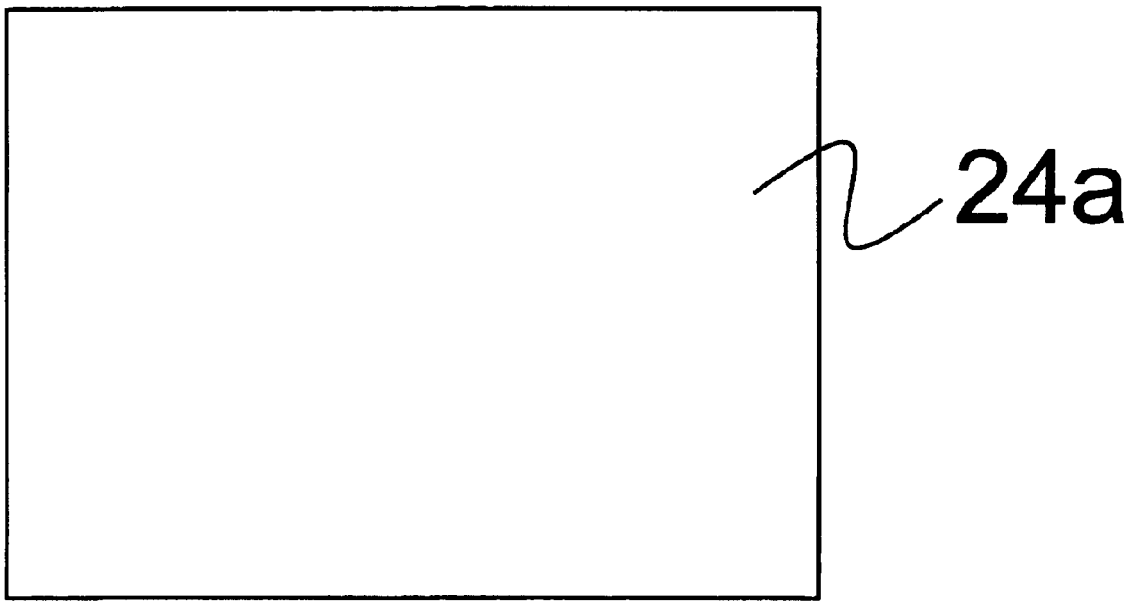
FIG. 6 is a plan view of the base plate of the embodiment of FIG. 3.

Referring to FIGS. 3 and 6, a third embodiment 11*b* of the support plate can be seen. The support plate 11*b* includes a substantially flat plate portion 24*a* and means 25 for anchoring the plate portion 24*a* to the ground or to a support structure 30. In the illustrated example of FIGS. 3 and 6, the means for anchoring the plate portion 24*a* to the ground or to the support structure 30, is a layer of adhesive 25 applied between the plate portion 24*a* and the ground or the support structure 30. The layer of adhesive 25 firmly binds the plate portion 24*a* to the ground or to the support structure 30. This mode of anchoring the plate portion 24*a* is most preferable when anchoring the plate portion 24*a* to a solid surface such as concrete, brick, stone, etc. The adhesive used for the layer 25 may be the type of adhesive commonly referred to as epoxy. In the illustrated example, the plate portion 24*a* is a simple, flat rectangular plate, although other suitable shapes may also be used.

The plate portions 24, 24*a*, and 36 can be made of a ferromagnetic material such as steel or any other material that is strongly attracted by the magnet 20.

With the plate portion 24, 24*a*, or 36 secured to the ground and the refuse container 10 placed on the plate portion, the magnetic attraction between the magnet 20 and the plate portion 24, 24*a*, or 36 tends to hold the refuse container 10 in place so as to provide a resistance to tipping of the refuse container 10. Thus, the magnetic attraction between the magnet 20 and the plate portion 24, 24*a*, or 36 tends to hold the refuse container 10 in place against, for example, the wind or animal activity.

It is to be understood that the embodiments of the present invention disclosed above are susceptible to various modifications, changes and adaptations by those skilled in the art, and that such modifications, changes and adaptations are to be considered within the spirit and scope of the invention. For example, the plate 36 may be used in conjunction with long stakes having flattened or bent heads in order to anchor the plate portion 36 directly to the ground 28. Also, the holes 42 in the plate 36 may be eliminated entirely and any stakes or the anchor bolts 32 may be positioned so as to abut the edges of the plate 36 such that the head of the stakes or the nuts 34 will catch the edges of the plate 36 in order to secure the plate 36 to the ground.

As yet another modification, the holes 42 may be counterbored or countersunk such that the heads of any stakes or the nuts 34 will not project above the top surface of the plate 36. Thus, the heads of any stakes or the nuts 34 will not interfere with the placement of the refuse container 10 on the plate 36.

It is to be understood that the present invention is not limited to the embodiments described above, but includes any and all embodiments within the scope of the appended claims.

What is claimed is:

1. A tip-resistant refuse container system comprising:

a refuse container having a bottom, said refuse container being sized such that it can receive at least one trash bag filled with refuse;

a magnet supported by said bottom of said refuse container; and a support plate adapted to be anchored to the ground, said support plate comprising a substantially flat plate portion, and means for anchoring said plate portion to the ground, wherein said means for anchoring said plate portion to the ground comprises at least one spike attached to said plate portion, whereby when said support plate is anchored to the ground and said refuse container is placed on said support plate, magnetic attraction between said magnet and said support plate provides a resistance to tipping of said refuse container.

2. The tip-resistant refuse container system according to claim 1, wherein said plate portion is made of a ferromagnetic material.

3. The tip-resistant refuse container system according to claim 1, wherein said refuse container has a top opening and a side wall surrounding said bottom and extending from said bottom to said top opening.

4. The tip-resistant refuse container system according to claim 3, wherein said refuse container further comprises a closure for said top opening.

5. The tip-resistant refuse container system according to claim 4, wherein said refuse container further comprises at least one handle attached to said sidewall.

6. A lip-resistant refuse container system comprising:

a refuse container having a bottom;

a magnet supported by said bottom of said refuse container; and a support plate adapted to be anchored to the ground, said support plate comprising a substantially flat plate portion and means for anchoring said plate portion to the ground, wherein said means for anchoring said plate portion to the ground comprises at least one spike attached to said plate portion, whereby when said support plate is anchored to the ground and said refuse container is placed on said support plate, magnetic attraction between said magnet and said support plate provides a resistance to tipping of said refuse container.

7. The tip-resistant refuse container system according to claim 6, wherein said plate portion is made of a ferromagnetic material.

8. A tip-resistant refuse container system comprising:

a refuse container having a bottom, said refuse container having a top opening and a side wall surrounding said bottom and extending from said bottom to said top opening;

at least one handle attached to said side wall;

a magnet supported by said bottom of said refuse container; and a support plate adapted to be anchored to the ground, said support plate comprising a substantially flat plate portion and means for anchoring said plate portion to the ground, wherein said means for anchoring said plate portion to the around comprises at least one spike attached to said plate portion, whereby when said support plate is anchored to the ground and said refuse container is placed on said support plate, magnetic attraction between said magnet and said support plate provides a resistance to tipping of said refuse container.

9. The tip-resistant refuse container system according to claim 8, wherein said refuse container further comprises a closure for said top opening.

10. The tip-resistant refuse container system according to claim 8, wherein said plate portion is made of a ferromagnetic material.

* * * * *

UNITED STATES PATENT AND TRADEMARK OFFICE

CERTIFICATE OF CORRECTION

PATENT NO. : 6,786,349 B2
DATED : September 7, 2004
INVENTOR(S) : Fadi Najd

It is certified that error appears in the above-identified patent and that said Letters Patent is hereby corrected as shown below:

Column 5,
Line 11, replace "A lip-resistant" with -- A tip-resistant --.

Signed and Sealed this

Eleventh Day of January, 2005

JON W. DUDAS
*Director of the United States Patent and Trademark Office*